US007987911B2

(12) United States Patent
Rhodes et al.

(10) Patent No.: US 7,987,911 B2
(45) Date of Patent: Aug. 2, 2011

(54) OIL WELL PERFORATORS

(75) Inventors: Mark R Rhodes, Kent (GB); Stephen Wheller, Kent (GB); Anthony J Whelan, Kent (GB); Michael R Hoar, Longfield (GB); Neil Cole, Maidstone (GB)

(73) Assignee: Qinetiq Limited, Farnborough, Hampshire (GB)

( * ) Notice: Subject to any disclaimer, the term of this patent is extended or adjusted under 35 U.S.C. 154(b) by 161 days.

(21) Appl. No.: 11/667,195

(22) PCT Filed: Nov. 16, 2005

(86) PCT No.: PCT/GB2005/004428

§ 371 (c)(1),
(2), (4) Date: May 7, 2007

(87) PCT Pub. No.: WO2006/054081

PCT Pub. Date: May 26, 2006

(65) Prior Publication Data

US 2009/0050321 A1 Feb. 26, 2009

(30) Foreign Application Priority Data

Nov. 16, 2004 (GB) ..... 0425203.7

(51) Int. Cl.
*E21B 43/117* (2006.01)

(52) U.S. Cl. ..... 166/297; 166/55.2; 175/4.6; 102/476

(58) Field of Classification Search ..... 166/297, 166/55.2; 175/4.6; 102/476
See application file for complete search history.

(56) References Cited

U.S. PATENT DOCUMENTS

| | | | | |
|---|---|---|---|---|
| 3,025,794 | A | 3/1962 | Lebourg et al. | |
| 4,498,367 | A | 2/1985 | Skolnick et al. | |
| 4,766,813 | A | 8/1988 | Winter et al. | |
| 5,522,319 | A | 6/1996 | Haselman et al. | |
| 6,021,714 | A * | 2/2000 | Grove et al. | 102/307 |
| 6,668,726 | B2 * | 12/2003 | Lussier | 102/307 |
| 2002/0112564 | A1 | 8/2002 | Leidel et al. | |

(Continued)

FOREIGN PATENT DOCUMENTS

| | | |
|---|---|---|
| DE | 23 06 859 A1 | 8/1974 |

(Continued)

OTHER PUBLICATIONS

International Search Report mailed Mar. 6, 2006.

(Continued)

*Primary Examiner* — Giovanna C Wright
(74) *Attorney, Agent, or Firm* — Nixon & Vanderhye P.C.

(57) ABSTRACT

An oil and gas well shaped charge perforator is provided comprising a housing, a high explosive, and a liner with a further insert liner where the high explosive is positioned between the liner and the housing. In use the high explosive will collapse the liner and insert causing two cutting jets to form. The insert may substantially cover the surface area of the liner or it may over only partially cover the liner, such as the apical portion of the liner or the base portion of liner. Alternatively the insert may be varied in thickness across the surface area of the liner. Typically the thickness of the liner may be between 1 and 10% of the liner diameter and the thickness of the insert may be between 1 and 200% of the thickness of the liner. The insert may be produced during the manufacture of the liner, but preferably the liner will be a retro fitted item.

18 Claims, 2 Drawing Sheets

U.S. PATENT DOCUMENTS

| | | | | |
|---|---|---|---|---|
| 2002/0162474 | A1 * | 11/2002 | Pratt et al. | 102/307 |
| 2003/0037692 | A1 | 2/2003 | Liu | |
| 2005/0011395 | A1 * | 1/2005 | Langan et al. | 102/476 |
| 2007/0056462 | A1 * | 3/2007 | Bates et al. | 102/476 |
| 2007/0214991 | A1 * | 9/2007 | Ronn et al. | 102/306 |

FOREIGN PATENT DOCUMENTS

| | | | |
|---|---|---|---|
| DE | 2927556 | | 5/1985 |
| DE | 196 30 339 | A1 | 1/1997 |
| EP | 437 992 | A | 7/1991 |
| EP | 1 124 433 | A | 9/2002 |
| EP | 1241433 | A2 * | 9/2002 |
| GB | 2 116 298 | A | 9/1983 |
| GB | 2 298 910 | A | 9/1996 |
| GB | 2 303 687 | A | 2/1997 |
| GB | 2303687 | A * | 2/1997 |
| GB | 2 333 825 | A | 8/1999 |
| GB | 2 389 888 | A | 12/2003 |

OTHER PUBLICATIONS

United Kingdom Search Report dated Mar. 7, 2006.

Written Opinion of the International Searching Authority, received May 7, 2007.

* cited by examiner

OIL WELL PERFORATORS

This application is the U.S. national phase of International Application No. PCT/GB2005/004428 filed 16 Nov. 2005 which designated the U.S. and claims priority to 0425203.7 filed 16 Nov. 2004, the entire contents of each of which are hereby incorporated by reference.

The present invention relates to a shaped charge liner capable of producing multiple number of cutting jets to enhance the penetration into the well completion.

By far the most significant process in carrying out a completion in a cased well is that of providing a flow path between the production zone, also known as a formation, and the well bore. Typically, when employing the use of a perforator, upon initiation of the device the cutting jet creates an aperture in the casing or casings and then proceeds to penetrate into the formation via a cementing layer. This whole process is commonly referred to as a perforation. Although mechanical perforating devices are known, almost overwhelmingly such perforations are formed by using shaped charge devices because they are efficient, readily deployable and are capable of multiple perforations, for example 30,000 or more may be used in one completion. Energetic devices can also confer additional benefits in that they may provide stimulation to the well in the sense that the shock wave passing into the formation can enhance the effectiveness of the perforation and produce an increased flow from the formation. Typically, such a perforator will take the form of a shaped charge, also known as a hollow charge. In the following, any reference to a perforator, unless otherwise qualified, should be taken to mean a shaped charge perforator.

A shaped charge is an energetic device made up of a casing or housing, usually cylindrical, within which is placed a relatively thin metallic liner. The liner provides one internal surface of a void, the remaining surfaces being provided by the housing. The void is filled with energetic explosive material which, when detonated, causes the liner material to collapse and be ejected from the housing in the form of a high velocity jet of material. This jet impacts upon the well casing creating an aperture, the jet then continues to penetrate into the formation itself, until the jet is consumed by the "target" materials in the casing, cement and formation. The liner may be hemispherical but in most perforators the shape is generally conical. Conventionally the shaped charge housing will be manufactured from steel or aluminium alloy, although other ferrous and non ferrous alloys may be preferred. In use, as has been mentioned the liner forms a very high velocity jet that has great penetrative power.

Generally, a large number of perforations are required in a particular region of the casing proximate to the formation. To this end, a so called gun is deployed into the casing by wireline, coiled tubing or indeed any other technique known to those skilled in the art. The gun is effectively a carrier for a plurality of perforators that may be of the same or differing output. The precise type of perforator, their number and the size of the gun are a matter generally decided upon by a completion engineer, based on an analysis and/or assessment of the characteristics of the completion. Generally, the aim of the completion engineer is to obtain the largest possible aperture in the casing together with the deepest possible penetration into the surrounding formation. It will be appreciated that the nature of a formation may vary both from completion to completion and also within the extent of a particular completion.

Typically, the selection of the perforating charges, their number and arrangement within a gun and indeed the type of gun is decided upon by the completion engineer, who will base his decision on an empirical approach born of experience and knowledge of the particular formation in which the completion is taking place. However, to assist the engineer in his selection a range of tests and procedures have been developed for the characterisation of an individual perforator's performance. These tests and procedures have been developed by the industry via the American Petroleum Institute (API). For deep hole perforators the API standard RP 19B (formerly RP 43 5$^{th}$ Edition) currently available for download from www.api.org is used widely by the perforator community as an indication of perforator performance. Manufacturers of perforators typically utilise this API standard for marketing their products. The completion engineer is therefore able to select between products of different manufacturers for a perforator having the performance they believe is required for the particular formation. In making the selection, the engineer can be confident of the type of performance that might be expected from the selected perforator.

Nevertheless, despite the existence of these tests and procedures it is recognised that completion engineering remains at heart more of an art than a science. It has been recognised by the inventors in respect of the invention set out herein, that the conservative nature of the current approach to completion has failed to bring about the change in the approach to completion engineering required, to enhance and increase production from both straightforward and complex completions.

There is a requirement in the oil and gas completion industry, to produce both deep hole (DP) perforators and big hole perforators. Different completions have different geology. At one end of the scale there are consolidated hard rock formations that require a large amount of highly focussed jet energy to perforate. Deep hole perforators as their name implies, are intended to provide the deepest possible hole, to penetrate as far as possible into the formation and are generally used where the formation consists of hard rock.

At the other end of the scale there are unconsolidated formations, that is loose fill material, for example sand, which is easy to displace but may readily collapse with the passage of time. Big hole perforators are intended to provide the largest possible entry hole in the casing(s). The increased diameter of the entry holes in the casing improve the placement of sand in the perforation tunnels and help to reduce the pressure drop through each individual perforation tunnel to provide improved flow characteristics, to produce the greatest flow of hydrocarbons per unit area and also to increase well reliability.

The metric for the flow of material from a perforation in a completion, is characterised by the entry hole diameter and the inflow of hydrocarbon per linear foot of gun casing.

There is a dichotomy in the industry, as to the optimum way to increase the flow of hydrocarbons, i.e. whether to use a big hole perforator or a deep hole perforator. The drawbacks of a deep hole perforator are mainly that the hole created by the cutting jet is narrow and tapers in at the tip of the jet. The hole that is produced is usually very clean almost as though it had been drilled, which keeps the pressure in the completion high, but with a relatively low flow rate. In contrast the big hole perforator allows a large flow per unit area, however the depth of penetration is very limited.

Ideally it is desirable to create the maximum possible flow per unit area from each perforation and to also to ensure that the perforation is as deep as possible. One approach is to use a tandem perforator i.e. one liner directly behind the other, although this can have its own associated cost implications and, there are constraints on the size of the perforator in this set up, as the perforators will typically be mounted in the aforementioned carrier gun arrangement and so their diameter and length will be constrained such that they will fit into the gun. Similarly there is a constraint on the mass of explosive in each perforator, as it may be necessary for the gun to survive the detonations and be removed from the completion, to increase the flow of hydrocarbon material.

Another method for increasing the damage to a target or further increasing the extent of perforation in an oil and gas completion is to initiate a second shaped charge device along the same path as created by the first cutting jet, which is often referred in the military field as a tandem effect and is typically deployed by what is known as a tandem warhead. There are several methods of achieving a tandem effect, one method is to use two separate shaped charge units co axially aligned one behind the other, with the foremost shaped charge being initiated a few milliseconds before the rear shaped charge. This has been employed in the military field, where it has been used in bunker busters. In this application the first charge is designed to clear the earth mound from around the bunker and the second larger charge is designed to penetrate the reinforced concrete bunker. The idea being that the earth mound can be more effectively displaced by a smaller charge and thus maintaining the full penetrating effect of the second larger charge, whose energy can be more focussed onto the actual bunker.

A further method for producing a tandem effect has been disclosed in GB application 0102914.9, which detailed the use of a tandem liner, which comprises a linear cutting charge with a typically chevron cross section, used in combination with a conventional shaped charge device, such that in use the linear cutting charge disrupted the casing of the gun and allowed the cutting jet from the shaped charge unit to be focussed upon the rock strata of the completion, akin to the tandem warhead.

One disadvantage of both of these systems is that they require independent initiation means for each of the cutting jets. Further, these designs require additional engineering of the final shaped charge unit to incorporate either the linear cutting charge or another co-axially aligned shaped charge unit.

Patent applications and patents GB 2303687 A (Western Atlas), GB 2333825A (Schlumberger), U.S. Pat. No. 3,025,794 (Lebourg), and U.S. Pat. No. 4,498,367 A (Skolnick) all disclose perforators which create slugs; patent application EP 0437992 A (France Etat) discloses perforators creating a pair of explosively-formed projectiles.

Patent applications US 2003/0037692 A (Liu) and GB 0916870 A disclose perforators utilising reactive liners.

U.S. Pat. No. 4,766,813 (Winter) discloses composite liners for shaped charge devices.

Patent application DE 2927556 C (Messerschmidt) discloses hollow charge casings in which the casing has a higher specific density in the region of its point than at its mouth.

Therefore there is a requirement for a shaped charge unit which is capable of producing more than one cutting jet, but avoids one or more disadvantages of the prior systems.

Accordingly the present invention provides a multiple jet, oil and gas well shaped charge perforator liner, which comprises a primary liner and one or more one insert liners nested on the inner surface of the primary liner, such that in use at least 2 cuffing jets are produced.

It will be readily appreciated that there may be a plurality of inserts applied to the internal surface of the shaped charge.

The liner thickness may be selected from any known thickness, but the wall thickness is preferably selected in the range of from 1 to 10% of the liner diameter, more preferably in the range of from 1 to 5%.

The shape of the liner or insert may be selected from any known or commonly used shaped charge liner shape, such as substantially conical, or hemispherical. It will be readily appreciated by the skilled person of the correct shape of the insert, such as to allow the insert and the liner to come into intimate contact.

In one arrangement the liner or insert may possess tapering walls, such that the thickness at the apex is reduced compared to the thickness at the base of the liner or insert, or alternatively the taper may be selected such that the apex of the liner or insert is substantially thicker than the walls. A yet further alternative is where the thickness of the liner or insert is not uniform across its surface area, such as to produce a taper or a plurality of protrusions and substantially void regions, to provide regions of variable thickness, which may extend fully or partially across the surface area of the liner or insert, allowing the velocity and cutting efficiency of the jets to be selected to meet the conditions of the completion at hand.

The insert may be any thickness but is preferably selected in the range of from 1% to 200% of the thickness of liner, even more preferably in the range of from 50% to 150% of the thickness of the liner.

The insert may substantially cover the inner surface area of the liner or be less than this, more preferably the surface area of the insert liner will be in the range of from 20% to 100% of the surface area of the primary liner.

The insert may be substantially frustro conical shaped such that the insert does not substantially cover the apex of the liner, preferably the insert will extend in the range of from 1% to 100% from the base to the apex of the liner, more preferably in the range of from 20 to 100% from the base to the apex of the liner. Alternatively the insert will extend in the range of from 1% to 100% from the apex to the base of the liner, more preferably in the range of from 20% to 100% from the apex to the base of the liner.

Further there may be a plurality of frustro conical portions inserted in a liner such as to create a series of frustro conical annuli on the surface of the liner (benefits), which may cover in the range of from 1% to 100% of the inner surface area of the liner, more preferably in the range of from 20% to 100%.

Alternatively the insert may cover substantially the apical portion of the liner and may extend substantially from the apex of the liner to the base of the liner, preferably the insert will extend in the range of from 1% to 100% from the apex of the liner to the base, more preferably in the range of from 20% to 100% from the apex to the base.

Alternatively the insert may be produced from a plurality of fingers or spines of insert material which extend substantially parallel to the surface of the liner, from the apex to the base of the liner, preferably the insert will extend in the range of from 1% to 100% from the apex of the liner to the base, more preferably in the range of from 20% to 100% from the apex to the base. Alternatively the fingers or spines extend substantially parallel to the surface of the liner, from the base to the apex of the liner, preferably the finger or spine of insert material will extend in the range of from 1% to 100% from the base of the liner to the apex, more preferably in the range of from 20% to 100% from the base to the apex of the liner.

In a further alternative the insert may vary in thickness across the surface area of the liner, such that the insert may be tapered or possess a plurality of protrusions and substantially void regions which may extend fully or partially across the inner surface area of the liner.

Factors which typically determine the performance of the perforator are the liner geometry and the type and mass of high explosive used. However the actual final length of the cutting jet and hence the depth of perforation will also depend on the geology of the completion. It will be readily appreciated by those skilled in the art as to the approximate depth of penetration and hence the likely final length or extent of the cutting jet for any given perforator in a given completion, therefore all references to the cutting jet's final length herein described will refer to the final length as would be judged to be achieved by the skilled completion engineer. For the purpose of clarity the path of the jet is defined hereinbefore and hereinafter as the channel which is so formed in the rock strata as a result of the action of the cutting jet.

The liner and the insert may be produced from any suitable or commonly used shaped charge liner material, typical materials are; metallic materials, alloys, polymers, silicas, glass or plastics. Alternatively the insert may be made from a composition that produces exothermic energy when under explosive loading. The insert may also be selected from the same material as the liner material.

Typically a metallic material is selected for the liner or insert in order to produce a dense liner or insert and thus provide an efficient penetrating jet. Typically, the density of the liner will be in the range 7 to 18 grams per cubic centimeter to produce an efficient hole in the casing(s). The metal may be selected from any metal or alloy that is commonly used in the field of shaped charge warheads, such as copper or tungsten or their alloys, such as brass or bronze. Other alloys include copper/tungsten alloys, which are widely used in the shaped charge field. The insert either fully or partially may also be produced from a metallic material.

The liner or insert may be produced by pressing or shear forming a wrought metal into a net or final desired shape. Alternatively the liner or insert material may be formed from a particulate composition, such as a green metal powder compact, where the powder is pressed to form the desired liner or insert shape. The pressed liner or insert may be produced to the final required size or slightly oversized to allow the liner or insert to be sintered or machined to the final size. It is usually desirable when using either a green compact or a sintering process to add a binder to aid consolidation of the particulate material. The binder material can either be added to the particulate material and thoroughly mixed, or the metallic particles can be pre-coated with the binder. The binder may be selected from a range of soft metal such as lead, polymeric or other non-metal materials. Polymeric binders which are commonly selected are stearates, wax, PTFE, polyethylene or epoxy resins. Other common and well known binders may also be effective and are readily deployed.

Alternatively an energetic polymer binder may be used, such as Polyglyn (Glycidyl nitrate polymer), GAP (Glycidyl azide polymer) or Polynimmo (3-nitratomethyl-3-methyloxetane polymer). Where a binder is present it may be present in the range of from 1% to 5% by volume of the liner material.

When a particulate composition is to be used, the diameter of the particles, also referred to as 'grain size', play an important role in the consolidation of the material and therefore affects the pressed density of the liner or insert. It is desirable to increase the density of the liner or insert, to produce a more effective hole forming jet. It is desirable that the diameter of the particles is less than 10 μm, more preferably the particles are 1 μm or less in diameter, and even more preferably, nano scale particles are used, such as particles which are 0.1 μm or less in diameter. Materials referred to herein with particulate sizes less than 0.1 μm are referred to as "nano-crystalline materials".

Ultra-fine powders comprising nano-crystalline particles can also be produced via a plasma arc reactor as described in PCT/GB01/00553 and WO 93/02787.

In one arrangement the liner may possess an insert which is machined or formed during the original manufacture of the liner, such that the original liner is produced oversize and is machined to reveal an insert portion capable of forming a second cutting jet.

In a preferred arrangement the insert is manufactured separately from the liner and is produced and attached to the liner as a retrofitted item. This allows the completion engineer more flexibility, and the ability to select the most appropriate insert for the completion at hand, thus avoiding the requirement of keeping in stock a large number of preformed units. Further the completion engineer may wish to use a plurality of different inserts to produce a plurality of cutting jets, each with their own characteristic properties.

The insert may be held in intimate contact with the liner to allow the insert to form a coherent jet, therefore the insert may be secured to the liner by any suitable retaining means, such as an adhesive, allowing a pre-contracted insert material to expand on contact with the liner, a retaining clip, a biasing means or further energetic material to hold the insert onto the surface of the liner.

In a further aspect of the invention there may be provided a further layer of energetic material sandwiched between the insert liner and the primary liner, such that upon the forced collapse of the primary liner the further layer of energetic material provides kinetic energy to the insert liner. The further layer of energetic material may be selected from any suitable energetic material, such as pyrotechnic, intermetallic, or high explosive, preferably it is selected from any known suitable high explosive.

According to a third aspect of the invention there is provided a shaped charge comprising a housing, a quantity of high explosive inserted into the housing, a primary liner, at least one insert liner.

Preferably the housing is made from steel although the housing may be manufactured from any known or commonly used housing material, and may also be produced by any one of common engineering techniques. The high explosive upon initiation will need to generate sufficient loading to cause the collapse of the liner to form a high velocity jet. Such an explosive may be selected from a range of high explosive products such as RDX, TNT, RDX/TNT, HMX, HMX/RDX, TATB, HNS, it will be readily appreciated that any energetic material classified as a high explosive may be used in the invention hereinbefore described. Some explosive types are however preferred for oil well perforators, due to the elevated temperatures encountered in the well bore completion.

The diameter of the liner at the widest point, that being the open end, can either be substantially the same diameter as the housing, such that it would be considered as a full calibre liner or alternatively the liner may be selected to be sub-calibre, such that the diameter of the liner is in the range of from 80% to 95% of the full diameter. In a typical conical shaped charge with a full calibre liner the explosive loading between the base of the liner and the housing is very small, such that in use the base of the cone will experience only a minimum amount of loading. Therefore in a sub calibre liner a greater mass of high explosive can be placed between the base of the liner and the housing to ensure that a greater proportion of the base liner is converted into the cutting jet.

The perforators as hereinbefore described may be inserted directly into any subterranean well, however it is usually desirable to incorporate the perforators into a gun as previously described, in order to allow a plurality of perforators to be deployed into the completion.

A method of improving fluid outflow from an oil or gas well is also provided, the method comprising the step of perforating the well using one or more shaped charge liners according to the present invention.

In order to assist in understanding the invention, a number of embodiments thereof will now be described, by way of example and with reference to the accompanying drawings, in which.

Figure 1:
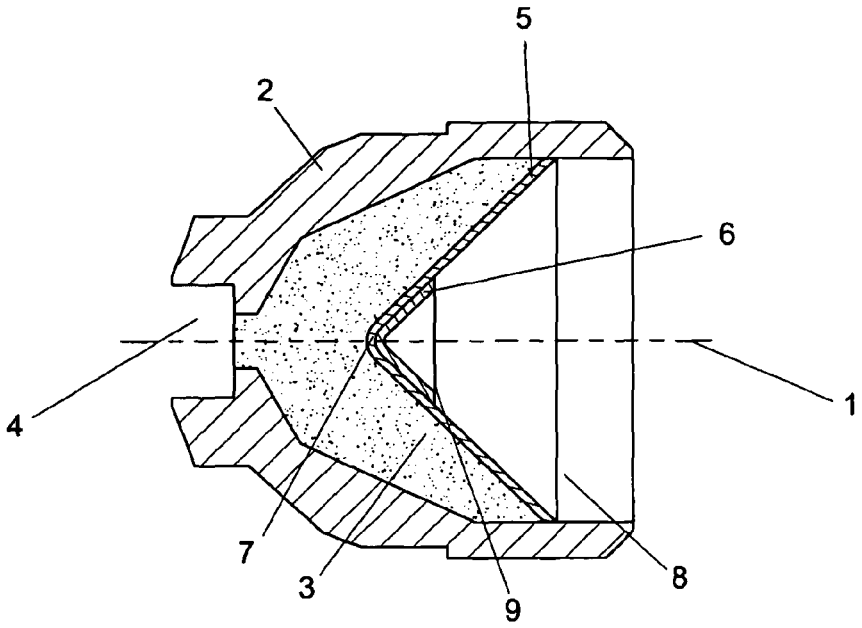
FIG. 1 is a cross-sectional view along a longitudinal axis of a shaped charge device in accordance with the invention containing an apical insert

As shown in FIG. 1 a shaped charge, typically axi-symmetric about centre line 1, of generally conventional configuration comprises a substantially cylindrical housing 2 produced from a metal, polymeric or GRP material. The liner 5 according to the invention, typically of say 1 to 5% of the liner diameter as wall thickness but may be as much as 10% in extreme cases. The liner 5 fits closely in the open end 8 of the cylindrical housing 2. High explosive material 3 is located within the volume enclosed between the housing and the liner. The high explosive material 3 is initiated at the closed end of the device, typically by a detonator or detonation transfer cord which is located in recess 4. The apex of the liner 7 has an insert 6, whose edge 9 is tapered towards the base, which substantially adopts the same shape of the apex 7 of the liner, such that upon initiation of the high explosive 3, the apex of the liner 7 and the insert 6 will form two discrete cutting jets.

A suitable starting material for the liner may comprise simply copper or brass. Another suitable starting material for the liner may comprise a mixture of nano-crystalline tungsten/copper powder mixture with a binder. The binder material comprises polymeric materials including energetic binders as described before. The nano-crystalline powder composition material can be obtained via any of the above mentioned processes.

One method of manufacture of liners is by pressing a measure of intimately mixed and blended powders in a die set to produce the finished liner as a green compact. In other circumstances according to this invention, intimately mixed powders may be employed in exactly the same way as described above, but the green compacted product is a near final shape allowing some form of sintering or infiltration process to take place.

Figure 2:
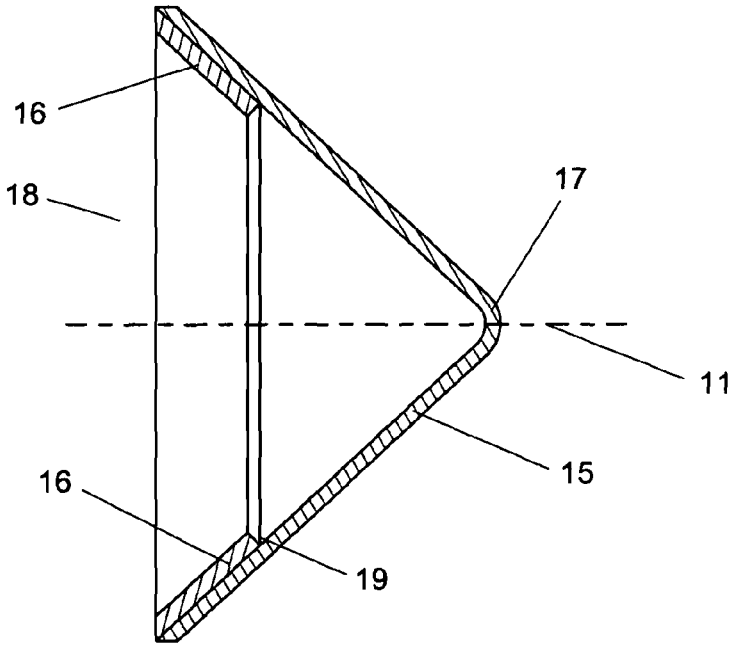
FIG. 2 shows a cross section view along a longitudinal axis of a shaped charge liner in accordance with the invention containing a frustro conical insert.

In FIG. 2 a liner according to the invention, typically axi-symmetric about centre line 11 which passes through apex 17 of the liner comprises a primary liner 15 and a typically frustro conical insert 16 located at the base 18 of the liner, where the edge 19 of the insert liner is substantially perpendicular to the primary liner 15. Such that when a liner of FIG. 2 is inserted in a shaped charge device, the insert 16 will form part of the slower moving portion of the cutting jet.

Figure 3:
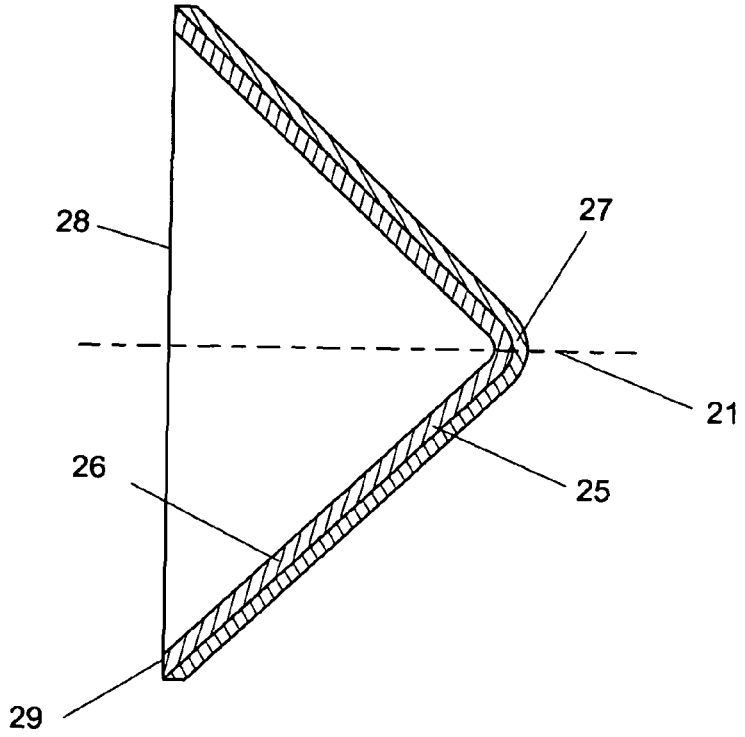
FIG. 3 shows a cross section view along a longitudinal axis of a shaped charge liner in accordance with the invention containing an insert which substantially covers the inner surface area of the liner.

As shown in FIG. 3 cross section view of a liner according to the invention, typically axi-symmetric about centre line 21 which passes through apex 27 of the liner. In this embodiment there is an insert 26 which substantially covers the inner surface area of the primary liner 25, from the apex 27 of the liner to the base 28 of the liner. Such that when the liner of FIG. 3 is inserted in a shaped charge device the insert 26 will form two cutting jets.

Figure 4:
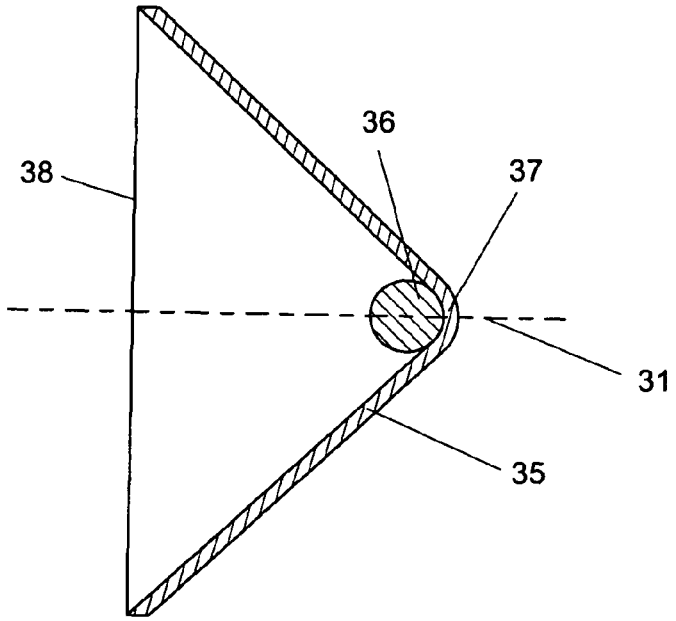
FIG. 4 shows a cross section view along a longitudinal axis of a shaped charge liner in accordance with the invention containing a substantially solid apical insert of different form to that shown in FIG. 1

As shown in FIG. 4 a liner according to the invention, typically axi-symmetric about centre line 31 which passes through apex 37 of the liner. In this embodiment there is an insert 36, typically a deposited mass of insert material, which may adopt the shape of the primary liner 35 or produce a solid frustum or adopt a substantially spherical shape, to provide additional material to form a cutting jet.

Modifications to the invention as specifically described will be apparent to those skilled in the art, and are to be considered as falling within the scope of the invention.

The invention claimed is:

1. A method of improving fluid outflow from an oil or gas well comprising the step of perforating the well using one or more multiple jet, oil and gas well shaped charge perforators, which comprise a primary liner and at least one insert liner nested on the inner surface of the primary liner, such that in use at least two cutting jets are produced, wherein the primary liner and/or the insert liner is a pressed liner formed from a particulate composition that has been manufactured by pressing particulate powders in the presence of a binder, and wherein the primary liner or insert liner comprise a composition capable of forming an exothermic reaction.

2. Method according to claim 1, wherein the density of the insert liner material is less than the density of the primary liner material.

3. Method according to claim 1, wherein the insert liner is co-axial with the primary liner.

4. Method according to claim 1, wherein the insert liner has the same shape as the primary liner.

5. Method according to claim 1, wherein the surface area of the insert liner is in the range of from 1% to 100% of the surface area of the primary liner.

6. Method according to claim 1, wherein the thickness of the primary liner is selected in the range of from 1 to 10% of the primary liner diameter.

7. Method according to claim 1, wherein the thickness of insert liner is selected in the range of from 1 to 200% of the thickness of the primary liner.

8. Method according to claim 1, wherein the primary liner and insert liner are selected from the same material.

9. Method as claimed in claim 1, wherein the particulate is made of a green metal powder compact, wherein the density is greater than 2 grams per cubic centimeter.

10. Method according to claim 1, wherein the particulates are 10 μm or less in diameter.

11. Method as claimed in claim 1, wherein the primary and/or insert liner material is a metallic material or an alloy and is coated with a binder material.

12. Method as claimed in claim 1, wherein the binder is selected from a group consisting of a polymer, soft metal and non-metal material.

13. Method according to claim 12, wherein the polymer is an energetic polymer.

14. Method according to claim 13, wherein the energetic polymer is selected from a group consisting of Polyglyn (Glycidyl nitrate polymer), GAP (Glycidyl azide polymer) and Polynimmo (3-nitratomethyl-3-methyloxetane polymer).

15. Method according to claim 1, wherein the binder is present in the range of from 1% to 5% by volume of the metallic material or alloy.

16. Method according to claim 1, wherein the primary liner diameter is full calibre or sub-calibre.

17. Method according to claim 1 wherein there is an energetic material enclosed between the insert liner and the primary liner.

18. Method according to claim 17, wherein the energetic material is selected from a group consisting of a high explosive, intermetallic and a pyrotechnic.

* * * * *